United States Patent [19]

Beacham et al.

[11] Patent Number: 4,905,562

[45] Date of Patent: Mar. 6, 1990

[54] METHOD FOR DERIVING AND REPLICATING COMPLEX MUSICAL TONES

[75] Inventors: Dwight A. Beacham, East Texas; Robert P. Woron, Allentown; John T. Whitefield, Harleysville, all of Pa.

[73] Assignee: Allen Organ Company, Macungie, Pa.

[21] Appl. No.: 94,005

[22] Filed: Sep. 8, 1987

[51] Int. Cl.[4] ..... G10H 1/02; G10H 1/06; G10H 3/00

[52] U.S. Cl. ..... 84/615; 84/616; 84/623; 84/627

[58] Field of Search ..... 84/1.11–1.13, 84/1.19–1.23, 1.26, 1.28

[56] References Cited

U.S. PATENT DOCUMENTS

| | | | |
|---|---|---|---|
| 2,989,886 | 6/1971 | Markowitz . | |
| 3,651,242 | 3/1972 | Evans | 84/1.11 |
| 3,740,450 | 6/1973 | Deutsch . | |
| 3,794,748 | 2/1974 | Deutsch . | |
| 3,913,442 | 10/1975 | Deutsch | 84/1.11 X |
| 3,978,755 | 9/1976 | Woron . | |
| 4,122,742 | 10/1978 | Deutsch | 84/1.11 |
| 4,184,403 | 1/1980 | Whitefield . | |
| 4,189,970 | 2/1980 | Woron . | |
| 4,352,312 | 10/1982 | Whitefield et al. . | |
| 4,383,462 | 5/1983 | Nagai et al. . | |
| 4,422,360 | 12/1983 | Carter | 84/1.11 |
| 4,493,237 | 1/1985 | DeLong et al. | 84/1.26 |
| 4,502,361 | 3/1985 | Viitanen et al. . | |
| 4,554,855 | 11/1985 | Alonso et al. | 84/1.22 |
| 4,656,428 | 4/1987 | Ishikawa | 84/1.12 X |
| 4,757,737 | 7/1988 | Conti | 84/1.12 |

*Primary Examiner*—Arthur T. Grimley
*Assistant Examiner*—Matthew S. Smith
*Attorney, Agent, or Firm*—Sanford J. Piltch

[57] ABSTRACT

A method for achieving the effect of air movement in instruments during replication and sounding of complex musical instruments by separating unstable frequency components, the quasi-periodic components, from stable fundamental and harmonic components, the periodic components, of compound voice waveforms, storing the respective component information pertaining to the quasi-periodic and periodic components in separate memory locations, and recombining the quasi-periodic component with one or more periodic components in appropriate fashion to form and sound the compound voice waveforms.

26 Claims, 3 Drawing Sheets

METHOD FOR DERIVING AND REPLICATING COMPLEX MUSICAL TONES

BACKGROUND OF THE INVENTION

This invention relates to electronic musical instrument tone generation. In particular the invention deals with the problem of simultaneously synthesizing the many different tones of a pipe organ electronically. Further, the invention deals with the problem of creating a plurality of simultaneously sounding, aesthetically desirable tones at reasonable cost.

Because of the long history and continued popularity of the pipe organ, high-quality electronic organ designers endeavor to understand and emulate the sounds of the pipe organ so as to retain, or even enhance, the particular characteristics which make the pipe organ so aesthetically appealing. At the same time the designers seek to exploit the unique advantages of the electronics approach to organ design.

One of the most distinctive features of the pipe organ is that it consists of a large collection of essentially independent tone generators, viz. the pipes. The fact that the pipes are spatially separated and have slightly different frequency and speech characteristics gives the pipe organ a dramatic ensemble sound.

One of the challenges of the electronic organ designer is to emulate this ensemble effect. The most direct method would be to replace each pipe with a separate, complete electro-acoustic pipe synthesizer, including tone generator, audio power amplifier, and speaker. Obviously this would be economically and perhaps even physically impractical. Fortunately, it has been discovered over the years that various liberties can be taken in designing the electronic organ so as to reduce the physical size and cost while still retaining much of the aesthetically appealing and desirable characteristics of the pipe organ. For example, it is common practice to combine the tones simulating many different pipes into a composite signal which is then amplified and converted to sound through an electro-acoustic speaker. Hence, many tones may share a single audio channel, i.e. audio amplifier and speaker, resulting in physical size reduction and cost savings. The selection of tones which are to be combined into one of several audio channels is one of the high-quality organ designer's principal challenges. The objective is to simulate the spatial separation of the individual pipes of a pipe organ by having the various electronically synthesized pipe tones emanate from some "reasonable" number of spatially separated speakers. This combining of plural tones into a limited number of audio channels has been done since the beginning of electrical and electronic organ technology. However, the development of the digital organ has permitted the combining of tones into composite signals in several audio channels to be accomplished with unprecedented efficiency. Furthermore, subsequent to its inception, many improvements have been made to the digital organ resulting in even more successful synthesis of the pipe organ.

With the invention of the digital organ came a degree of control previously unattainable. In the basic form of this type of organ, digital representations of organ pipe tone waveshapes and/or combinations of such waveshapes are stored in a memory. Activated keys on the organ are assigned to a small number of general purpose tone generators. Digital numbers are used to precisely control the repetitive readout from memory of the selected waveshape(s), or combination of waveshape(s), at the musical frequencies corresponding to the activated keys. The resulting digital data is converted to an analog signal by a digital-to-analog converter to form a composite audio signal representative of the keys being played and the tones or pipe voices selected by the performer. For a further description of the basic operation of a digital organ one can refer to U.S. Pat. No. 3,515,792 (Deutsch) and U.S. Pat. Nos. 3,610,799 and 3,639,913 (Watson), which patents are incorporated herein by reference as may be necessary or required for a full and complete understanding of the technology involved in digital electronic synthesis of pipe organ sounds.

The basic digital organ is particularly well suited to combining tones into a single audio channel. The combining is advatageously done in the waveshape memory circuitry. In other words, to combine two different tone waveshapes, it is merely necessary to read out a waveshape which represents the sum of the two selected tone waveshapes.

The basic digital organ is also adept at allowing tonal change from one region of a keyboard to another, as is desired in the synthesis of many voices of the pipe organ, especially certain Mixture voices. This is accomplished by merely addressing different sections of the waveshape memory according to the keyboard region in which the depressed key is located. In this way the particular waveshapes associated with each keyboard region are addressed and read out only by keys contained in the regions of the keyboard respectively associated with the separate sections of the waveshape memory.

Another desired characteristic of pipe organs is the frequency independence or frequency separation among the pipes speaking at the same pitch. This frequency separation adds to the ensemble or chorus effect. It has been observed that this effect can be well simulated by frequency-separating the various audio channels in the organ. In other words, each of the waveshape memory address generators, which are respectively associated with each audio channel, is made to "run" at a slightly different frequency compared to the other generators. One technique for doing this is further explained in U.S. Pat. No. 3,978,755 (Woron) which is incorporated herein by reference as may be necessary or required for a full and complete understanding of the technology involved in separating the frequency of electronically synthesized pipe organ sounds.

Thus, two important characteristics of the pipe organ, spatial separation and frequency separation, can be efficiently simulated electronically using digital electronic organ technology. There are yet, however, other characteristics of pipe organs which must be understood and effectively simulated in order to more closely replicate authentic pipe organ sounds.

It has long been known that the tones produced by many acoustic instruments, such as pipe organs, are not exactly periodic but are quasi-periodic. This is especially true during the attack portion of the tone, although quasi-periodicity is also often found during the sustained (or steady-state) portion of the tone. The term "quasi-periodicity" is used here to describe the deviation from periodicity often observed in these tones. These tones obviously possess a degree of periodicity because the ear perceives these tones as having a specific musical pitch. Musical pitch is associated closely with the concept of periodicity. However, a true periodic signal is one that exhibits exact cyclic repetition at regular intervals as time progresses; the shortest repeating pattern being termed a cycle of the periodic signal and the time interval occupied by one such cycle being termed the period of the signal. If a recording of an organ pipe is analyzed for periodicity, none can be found in the strict sense of the term. Some sections of the recording, particularly in the "steady-state" portion of the tone, do appear to be periodic at first glance; however, closer examination reveals that no two apparent "cycles" of the signal are configured exactly alike. Thus, the organ tone is close to being periodic, but there is a deviation from exact periodicity. This deviation typically is much greater in the attack transient portion of the tone as compared to the "steady-state" portion. It is this deviation from exact periodicity which enriches the tone aesthetically and contributes significantly to the overall favorable perception of its timbre.

The basic digital organ, as described in the Deutsch and Watson patents identified above, is highly adept at generating essentially periodic tones. Inducing the basic digital organ to simulate the various manifestations of the quasi-periodic nature of a pipe organ has been done in several ways. Building upon the insight developed in the pre-digital organ days concerning these various quasi-periodic effects, such as is explained in U.S. Pat. No. 2,989,886 (Markowitz), digital organ designers discovered various ways to produce similar effects in a digital organ.

In further explanation of this effect, U.S. Pat. No. 3,740,450 (Deutsch) discloses a method for simulating a "chiff" sound in a digital organ by combining a stored "chiff" waveshape with the steady-state waveshape during the attack portion of the tone generation. U.S. Pat. No. 4,184,403 (Whitefield) discloses an improved method for generating a time-dependent, variable waveshape, transient sound in a digital organ, which includes the "chiff" effect.

An improvement to the earlier Whitefield patent may be found in U.S. Pat. No. 4,352,312 (Whitefield/Woron) which discloses a method and apparatus for smoothly interpolating between the sequencially read out, stored waveshapes described in the '403 Whitefield patent. U.S. Pat. No. 4,189,970 (Woron) discloses a method for simulating "chiff" in a digital organ by distorting, or modulating, the steady state waveshape during the attack. The resulting transient sound is rich in harmonics because of the modulation of the steady-state tone signal by a segmentation signal.

These patents of Deutsch, Whitefield and Woron are especially suitable for simulating the "chiff" sound of a pipe organ. This "chiff" sound is defined as and generally refers to the initial turn-on transient characteristic of the pipes. Reference can be made to these patents, which are incorporated herein by reference, as may be necessary or required for a full and complete understanding of the "chiff" sound and the technology involved in electronically synthesizing such pipe organ sound.

Another quasi-periodic sound, not limited to the initial turn-on transient time frame, is the low level sound associated with the air flow through the pipe. Reference can be made to the '886 Markowitz patent for a further explanation of this air flow characteristic. The air flow sound adds a subtle randomly varying quality to the overall pipe tone. One method for simulating this pipe characteristic is to utilize the method for creating frequency modulation in a digital organ as disclosed in U.S. Pat. No. 3,794,748 (Deutsch) in conjunction with a randomly varying modulation signal. By judicious choice of variables, a randomly moving quality can be induced into the otherwise periodic signals so as to suggest the air flow effect found in air-driven organ pipes.

The methods discussed in the Deutsch, Whitefield and Woron patents identified above are all useful methods to induce a quasi-periodic action to take place in a basically periodic pipe tone waveshape organ system, i.e. the basic digital organ. However, there is a limited amount of control afforded by these methods. A highly discriminating listener can perceive differences between the pipe organ and its digital organ counterpart. These differences are related to the limited degree of accuracy achieved in simulating the quasi-periodic quality of the actual pipe organ sound by the methods so far discussed. This is due to the fact that these methods utilize the basic digital organ as a starting point. The problem stems from the fact that, in the basic digital organ, only enough information is stored to generate one cycle (or a small number of cycles) of the waveshape to be replicated at the appropriate pitch for audible reproduction. This places certain restrictions on the generated signals in that only certain harmonically related overtones can be reproduced with high accuracy. It is well known in signal analysis theory that periodic signals have spectra consisting only of purely harmonic overtones. It is believed that actual pipe organs generate tones which exhibit non-periodic overtones, at least during the turn-on transient phase. Thus, the basic digital organ as described above cannot be manipulated in any known way so as to perfectly simulate the subtle quasi-periodic aspects of actual organ pipes.

U S. Pat. No. 4,383,462 (Nagai/Okamoto) introduced a method for faithfully reproducing the actual waveshape of a desired tone during the attack transient and decay transient. This was accomplished by storing the complete transient portion of the desired tone in the memory of a tone generator and reading it out upon depression of a key. The decay transient portion of the tone can be reproduced similarly by storing the decay transient in the memory of another tone generator which is read out upon key release. The steady-state is generated using yet another generator of the periodic type described above. Thus, the Nagai/Okamoto technique provides one method for achieving greater accuracy in tone generation, with quasi-periodicity during the attack and decay transient portions of the tone. However, the steady-state, or sustained portion, of the tone suffers from the same limitations as with the basic periodic generator discussed above. This is due to the fact that Nagai and Okamoto utilize a separate periodic generator to simulate the steady-state portion of the tone. The Nagai/Okamoto method is also inefficient in that the technique requires individual tone generators for each portion of the tone.

With the development of the methods disclosed in U.S. Pat. No. 4,502,361 (Viitanen/Whitefield) came the ability to more accurately and more efficiently simulate the pipe organ, including quasi-periodicity during the steady-state portion of the tone. In this type of digital electronic organ, the complete attack transient portion of an organ pipe waveshape is stored in a memory along with a predetermined number of cycles of the "steady-state" sound. For example, an initial portion of the sound of an actual organ pipe may be sampled and the resulting signal placed in the memory of a tone generator. This signal is then read out, upon depression of a key, at the pitch or frequency associated with that key. Because the generated signal is a faithful playback of the originally recorded tone (except for frequency), all the nuances and characteristics of the organ pipe are contained in the generated signal including those related to quasi-periodicity.

A novel feature of this method is a provision to recirculate through a predetermined portion of the stored waveshape data after reaching a designated point in the stored data. Typically, when a key is depressed, the attack transient portion of the recorded organ pipe waveshape is read out along with the predetermined amount of the "steady-state" sound. When this process is completed, the recorded data is, in a sense, "used up" or depleted. At this point recirculation begins, utilizing the same recorded data in order to continue generating the "steady-state" portion of the tone. The Viitanen/-Whitefield method is considered to be an improvement over the Nagai/Okamoto system in that only a single tone generator is required compared to the at least two dedicated tone generators in Nagai/Okamoto. Also, the method of Viitanen/Whitefield provides for quasi-periodicity during the "steady-state" portion of the tone.

As previously stated, the "steady-state" portion of acoustically produced tones is often enriched by quasi-periodic qualities. It has been determined that the quasi-periodicity occurring during the "steady-state" portion of the tone does not require the degree of exactness required during the attack transient portion. Moreover, the discriminating ear is more conscious of the details of the sound during the attack transient portion of the tone generation and less concerned with the subtle quasi-periodic details during the "steady-state" portion of the sound. Thus, exact read out during the attack, and recirculation during the "steady-state" as described in the Viitanen/Whitefield patent produces excellent results in the quest for methods to generate aesthetically desirable organ tones electronically. While the method of Viitanen/Whitefield is not limited to organ tones, it is particularly well suited to generating the sounds of a pipe organ which is the principal problem addressed by the present invention.

One drawback to using the Viitanen/Whitefield system for building an electronic musical instrument capable of generating a plurality of simultaneously sounding, aesthetically desirable tones, such as high quality organ sounds, is cost. The reason for this is the extensive amount of memory required. Such a system is particularly memory intensive when different tones are required for different regions of the keyboard. Another costly aspect of using the Viitanen/Whitefield system for organ construction is the fact that the recirculation logic associated with tones of different pitch cannot be shared. This is because the recirculation logic is an extension of the frequency (or pitch) generator. Even tones of the same pitch often cannot share the same recirculation logic for two reasons. Firstly, frequency separation requires that separate frequency generators, and therefore separate recirculation logic, be used for tones having separate frequencies. Moreover, it is desirable to frequency-separate tones of the same pitch. Secondly, even in the case of tones having the same pitch and no frequency separation, it is often tonally desirable to provide each tone with its own independent recirculation pattern.

In summary, we have discussed two approaches to building an electronic instrument capable of generating a plurality of simultaneously sounding, aesthetically desirable tones. The first approach utilizes the basic digital organ which is geared to generating essentially periodic tones. Aesthetically desirable quasi-periodicity can by induced into the basic digital organ but there are fundamental characteristics, viz. strong periodicity, which limit the degree of exactness in attaining the desired sounds. The second approach utilizes an advanced digital organ concept which removes the limit of the first approach but is relatively costly. Therefore, prior to the discovery of the present invention, there was no known method to generate a plurality of simultaneously sounding, aesthetically desirable tones in a cost effective manner.

It is, therefore, an object of the present invention to permit the generation of a plurality of simultaneously sounding, aesthetically desirable organ pipe and other tones more accurately.

It is also an object of the present invention to reduce the number of memory and logic circuits, and the associated cost, to accomplish the replication of quasi-periodicity in a plurality of simultaneously sounding, aesthetically desirable organ pipe or other tones.

Other objects will appear hereinafter.

SUMMARY OF THE INVENTION

The invention is based on the discovery that a great many aesthetically pleasing tones, e.g. organ pipe sounds, can be separated into two, very different, types of components. The first component is strongly related to the "foundation" harmonic structure of the tone and found to be periodic in nature. The second component is strongly related to the time-varying, "unstable" yet aesthetically interesting portion of the tone and found to be quasi-periodic in nature. Obtaining the periodic "foundation" tone and the accompanying quasi-periodic "unstable" tone has been accomplished by judicious use of various signal processing techniques. When the tone is properly separated into these two components, several unobvious advantages arise.

The periodic "foundation" component is generated by the basic digital organ of Deutsch and Watson previously described. The quasi-periodic "unstable" component is generated by the advanced digital organ of Viitanen and Whitefield also previously described. It has been discovered that by proper arrangement of the structure of the present invention, a "compound" digital organ, all of the advantages of the basic digital organ described above can be retained while at the same time the "aesthetically desirable" advantages of the advanced digital organ can be exploited without the numerous memory elements and high cost heretofore associated with the "advanced digital organ"

The present invention may be used in an electronic musical instrument, or electronic organ, which may have a greater number of selectively actuable key switches than tone generators, to cause the production of sounds corresponding to the selected instrument voices at pitches corresponding to the respective notes of a musical scale, functions to replicate compound voice waveforms spanning the transient and steady-state portions of the voices which are selectable in the electronic musical instrument. The invention comprises means for storing the upper spectral frequency components of the voices, said upper spectral frequency components being the unstable quasi-periodic component waveforms of the voices containing non-harmonics along with some harmonics of said voices; means for storing the foundation or lower spectral frequency components of the voices, said lower spectral frequency components being the stable periodic component waveforms of the voices containing both the fundamental and a significant number of harmonics of said voices; means for generating addresses for selectively causing the reading from both storage means, in accordance with the selective actuation of key and stop switches for choosing notes and voices, the quasi-periodic component waveform and the periodic component waveform of one or more selected voices; and means for converting the waveform outputs of the storage means of the quasi-periodic component and the waveform outputs of the storage means of the periodic component of the one or more selected voices to form the compound voice waveform of the one or more selected voices.

Further, means are provided for selectively controlling the envelope waveforms corresponding to the actual sound applied to the quasi-periodic component waveform and to the periodic component waveform. A first method causes the quasi-periodic component waveform envelope, at the onset of the sounding of the one or more selected voices, to gradually increase to a predetermined value throughout the attack transient portion, to maintain that value throughout the steady-state portion, and to gradually diminish in value to effect the decay transient portion of the selected voice in response to the actuable key switches. A second method causes the quasi-periodic component waveform envelope, at the onset of the sounding of one or more selected voices, to instantaneously achieve a predetermined value and to maintain that value throughout the attack transient and steady-state portions and to gradually diminish in value to effect the decay transient portion of the selected voice in response to the actuable key switches. A third method causes the quasi-periodic component waveform envelope, at the onset of the sounding of one or more selected voices, to instantaneously achieve a predetermined value and to maintain that value throughout the attack and decay transient and steady-state portions of the selected voice permitting whatever natural transient and steady-state characteristics of the waveform envelope to be replicated. For each of the three cited methods of controlling the quasi-periodic component waveform envelope the periodic component waveform envelope is caused, at the onset of the sounding of the one or more selected voices, to gradually increase to a predetermined value during the attack transient portion, to maintain that value throughout the steady-state portion, and to gradually diminish in value to effect the decay transient portion of the selected voice in response to the actuable key switches. One of the three methods of controlling the envelope waveshape is applied during the replication and sounding of the one or more selected voices.

Means are also provided for selectively controlling the recirculation of the quasi-periodic component waveform during the replication and sounding of the one or more selected voices in the present invention. Further, means are provided for selectively enabling one or more quasi-periodic component storage means in accordance with the selective actuation of control or stop switches. The invention may be used to sound one or more selected voices simultaneously, but will sound at least one selected voice upon the selective actuation of the switches for choosing notes and voices.

Also disclosed is a method of deriving and replicating compound voice waveforms spanning the transient and steady-state portions of the voices in an electronic musical instrument, or an electronic organ, which may have a greater number of selectively actuable key switches than tone generators, to cause the production of sounds corresponding to the selected instrument voices at pitches corresponding to the respective notes of a musical scale comprising the steps of separating the upper spectral frequency components of the voices from the lower spectral frequency components of said voices, said upper spectral frequency components being the unstable quasi-periodic component waveforms of the voices containing non-harmonics along with some harmonics of said voices; providing means for storing the quasi-periodic component waveforms of the voices; providing means for storing the foundation or lower spectral frequency components of the voices, said lower spectral frequency components being the stable periodic component waveforms of the voices containing both the fundamental and a significant number of harmonics of said voices; providing means for generating addresses for selectively causing the reading from both storage means, in accordance with the selective actuation of key and stop switches for choosing notes and voices, the quasi-periodic component waveform and the periodic component waveform of one or more selected voices; and converting the waveform outputs of the storage means of the quasi-periodic component and the waveform outputs of the storage means of the periodic component of the one or more selected voices to form the compound voice waveform corresponding to the actual sound of the one or more selected voices.

The method further comprises the steps of providing means for selectively controlling the envelope waveforms applied to the quasi-periodic component waveform and the periodic component waveform as set forth above. Additionally, the method further comprises the step of providing means for selectively controlling the recirculation of the quasi-periodic component waveform during the replication and sounding of the one or more selected voices. Further, the method provides for selectively enabling one or more quasi-periodic component storage means in accordance with the selective actuation of control or stop switches. Similarly to the apparatus, the method is used to sound one or more selected voices simultaneously, but may also sound at least one selected voice upon the actuation of the switches for choosing notes and voices.

BRIEF DESCRIPTION OF THE DRAWINGS

For the purposes of illustrating the invention, there are shown in the drawings forms which are presently preferred; it being understood, however, that the invention is not limited to the precise arrangements and instrumentalities shown.

DETAILED DESCRIPTION OF THE PREFERRED EMBODIMENTS OF THE INVENTION

Figure 1:
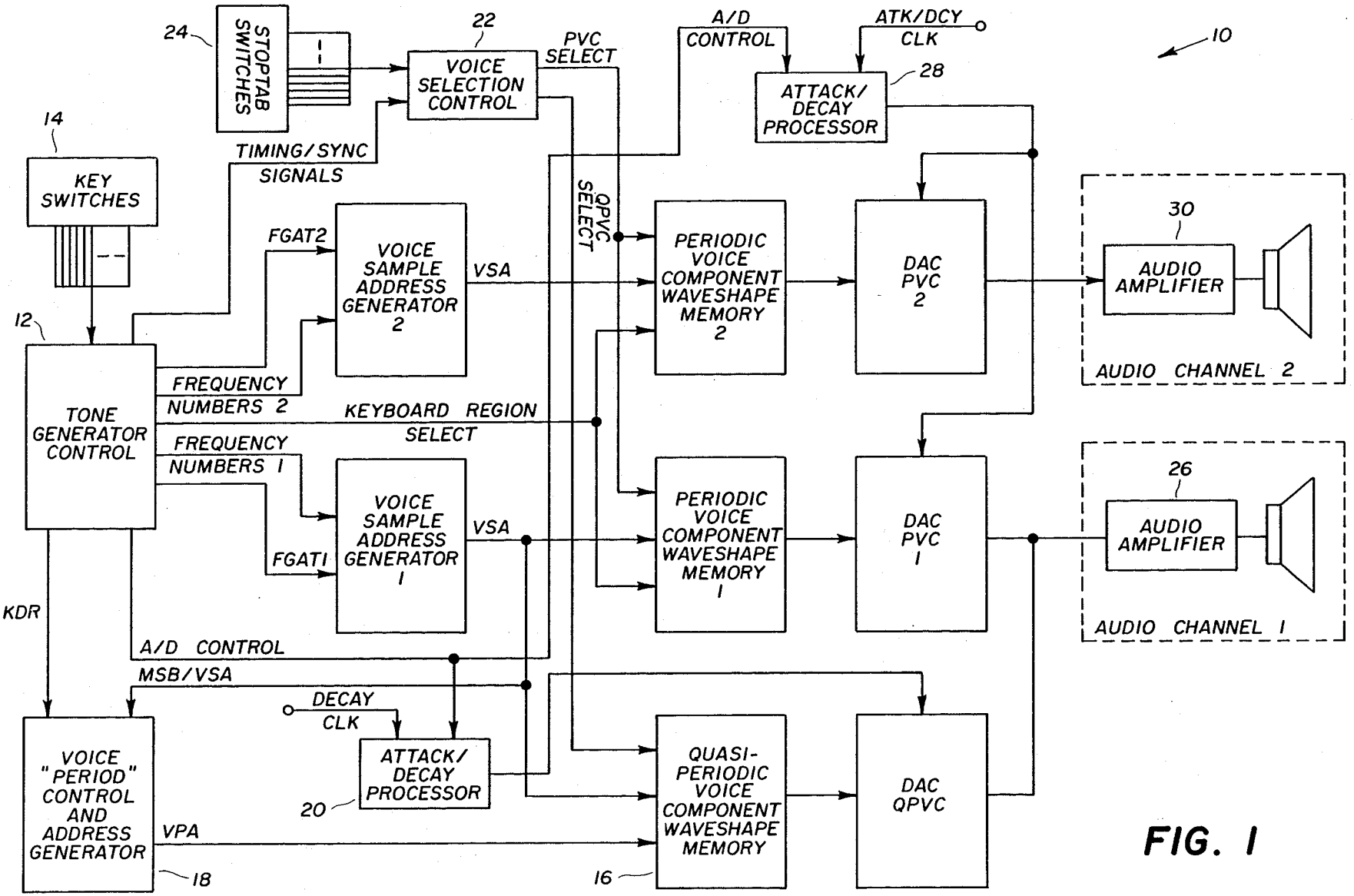
FIG. 1 is a schematic diagram, in the form of a block diagram, of an electronic musical instrument embodying an apparatus for replicating the compound musical tones in accordance with the present invention.

The following detailed description is of the best presently contemplated modes of carrying out the present invention. This description is not intended in a limiting sense but is made solely for the purpose of illustrating the general principles of the invention.

In one preferred embodiment of the compound digital organ the periodic "foundation" components of the tones are generated using the basic digital organ and its improvements, i.e. the '755 Woron and '403 Whitefield patents. Full advantage is taken of the strong points of the basic digital organ; spatial separation, frequency separation, and tonal variation according to keyboard region. Because the "foundation" components are musically useful without further enchancement, there is an advantage in having them separately generated in that further enhancement, although aesthetically very important, can be selectively turned off and thereby economically add to the tonal variety available to the performer.

In order to complete the aesthetically desirable synthesis of the organ tones, it is necessary to enhance the "foundation" components. This enhancement involves the generation of the quasi-periodic "unstable" frequency components respectively associated with the periodic "foundation" components. The quasi-periodic "unstable" frequency components are generated using the advanced digital organ techniques of the '361 Viitanen/Whitefield patent. However, because we are now only dealing with one component of the tone, i.e. the separated "unstable" frequency components, it has been found that several unobvious liberties can be taken resulting in substantial component reduction and cost savings compared with using the Viitanen/Whitefield technique alone to generate the tones.

It has been found that when dealing with tonal variation dependent on keyboard region, it is not necessary to vary the "unstable" frequency components as a function of a keyboard region. In other words, it has been found that, given the compound digital organ arrangement, even the discriminating ear is well satisfied as long as the periodic "foundation" component changes appropriately from keyboard region to keyboard region and there is a single, properly selected, "typical", quasi-periodic, "unstable" frequency component being generated along with, and in addition to, the keyboard-region-dependent periodic "foundation" component. Thus, a great savings is realized in that only one memory-intensive quasi-periodic component storage element is required in conjunction with several memory-efficient periodic component storage elements. The tone resulting from the combination of the periodic and quasi-periodic components was found to be aesthetically desirable.

Another advantage of the compound digital organ is that a single, properly selected, "typical", quasi-periodic, "unstable" frequency component can serve two or more periodic "foundation" components, resulting in the efficient generation of two or more aesthetically desirable, complete tones. Memory and related logic circuits and the related cost of these components are saved.

The ear perceives that there is frequency separation entirely by "listening" to the frequency separation between the "foundation" components. Thus, frequency separation can be achieved by merely separating the two or more "foundation" components. The single quasi-periodic component is completely sufficient to add the required "unstable" interesting essence to each tone separately, or in combination.

Other arrangements of the compound digital organ are realizable. For example, two quasi-periodic components which could have separate recirculation logic can share the same recirculation logic. These two quasi-periodic components can then be associated with two periodic "foundation" components, whether or not the "foundation" components are frequency separated. In this case there is a further component and cost reduction through the sharing of the recirculation hardware. Further, one or more quasi-periodic components can be selectably added to or withheld from the compound waveform of the selected voices or tones. This form of alternate embodiment will be described in detail below.

The effectiveness of the methodology taught by the invention has been successfully demonstrated in the form of several models which have been built and evaluated. The evaluations have shown that the compound digital organ does, in fact, allow the generation of aesthetically desirable organ tones using a minimum number of components and realizing a cost efficiency heretofore unattainable using known component configurations.

Many variations of the compound organ are possible. This is highly desirable in that it allows for a range of organ models of varying complexity. Although many different configurations may be found in practice, the illustrative configuration shown in FIG. 1 will be used to describe the several novel features of the invention.

Referring now to the drawings in detail, wherein like numerals indicate like elements, there is showing FIG. 1 a schematic, in block diagram form, of an electronic musical instrument in accordance with the present invention. An electronic musical instrument or digital electronic musical instrument in which the present invention may be applied and used is described in detail in U.S. Pat. Nos. 3,515,792, 3,610,799 and 3,639,913 and in U.S. Pat. No. 4,502,361 which are assigned to the assignee of the present invention. In addition, certain elements of the present invention are described in greater detail in U.S. Pat. Nos. 3,610,805, 4,184,403 and 4,352,312 which are also assigned to the assignee of the present invention. Reference may be had to these patents for detailed descriptions of the components referred to herein, other than the present invention, producing structural relationships in accordance with the invention.

In FIG. 1, which is exemplary of one configuration for a compound digital electronic musical instrument or organ 10, there is shown a tone generator control 12 which receives inputs from the keys or key switches 14 of the electronic musical instrument in the form of actuation and deactuation information. The function of the tone generator control 12 is to monitor and control the activity of the tone generators (or tone generator channels) based on the actuation-deactuation status of the keys or key switches 14. Methods for accomplishing tone generator control in digital electronic musical instruments are well known in the field. Reference can be made to U.S. Pat. No. 4,502,361 (Viitanen/Whitefield) where a frequency synthesizer, key assignor, and key down reset generator are used to perform the same functions as the tone generator control 12 in the present invention. However, the compound digital electronic organ of the present invention consists of a combination of basic periodic tone generators (such as described in the Deutsch and Watson patents) and advanced quasi-periodic tone generators (as described in the Viitanen/-Whitefield patent). The tone generator control 12 is shared by both kinds of generators. The control of the quasi-periodic type of tone generator is described in detail in the '361 Viitanen/Whitefield patent. A typical method of controlling the basic periodic type of tone generator is described in the '799 Watson patent, the '403 Whitefield patent and/or the '312 Whitefield/Woron patent.

Before continuing with the explanation of the physical elements of the present invention, it is believed necessary to discuss the derivation of the periodic and quasi-periodic components of the organ pipe or other voice waveshapes. The actual sound made by an organ pipe or other musical instrument is recorded electronically using a recorder capable of accurately recording the full frequency spectrum of the instrument. The recorder requires a bandwidth beginning at approximately 50 hertz and extending to approximately 22,000 hertz. A recording is made of the complete instrument sound, the attack transient, the steady state, and the decay transient portions. Hence, all of the air column movement which creates the sound is recorded in the case of a pipe voice with similar results for other acoustic and non-acoustic instruments.

The complete recording is sampled with the resulting sampled waveshape passed through a digital high pass filter. The digital high pass filter separates the foundation or lower spectral frequency components, the fundamental and a substantial number of the significant harmonics of the pipe voice or other instrument voice, from the upper spectral frequency components. The resulting waveshape of the upper spectral frequency components contains the "unstable" or non-harmonic frequency components of the particular instrument or pipe voice, the unstable frequency components being the quasi-periodic waveshape component of the pipe voice or other instrument voice. The upper spectral or unstable frequency components of the pipe voice or other instrument voice may, however, contain some of the harmonics of the voice. The sampled quasi-periodic waveshape is then retained for use in the present invention. It should be noted that the foregoing is but one means of deriving the appropriate components for use in the compound digital organ. Any means for separating the unstable frequency components from the stable foundation frequency components of a voice now known or developed and/or discovered in the future would be suitable.

Referring again to FIG. 1, an explanation of the quasi-periodic generator portion of the compound organ can be made by reference to the '361 Viitanen/-Whitefield patent by relating the functions and interrelationships of several elements of that patent to similarly functioning elements of the present invention. In some instances several elements of the '361 patent are grouped together forming a single element in the present invention. A detailed explanation of the function of each of the referenced elements may be found in the '361 patent which explanation is incorporated herein by such reference. As previously noted, the tone generator control 12 encompasses a frequency synthesizer, a key assignor, and a key down reset generator. The tone generator control 12 provides frequency number and frequency gating pulse outputs (Frequency Nos. 1 and 2 and FGAT 1 and 2), respectively. These signals provide the required input information to the voice sample address generators 1 and 2. The voice sample address generators 1, 2 have functions similar to the note generator of the '361 patent. Additional information relating to the configuration of the voice sample address generators 1, 2 may be found in the '403 Whitefield patent and in the earlier Deutsch and Watson patents which descriptions are also incorporated herein by reference. Each of the voice sample address generators creates a voice sample address, VSA, which is applied as part of the address of the periodic voice component waveshape memories 1 and 2 and the quasi-periodic voice component waveshape memory 16, as will be more fully described below.

The most significant bit of the voice sample address, MSB/VSA, is applied to the voice "period" control and address generator 18. The voice "period" control and address generator 18 performs functions similar to the voice period address generator, the pseudo random generator, and the recirculation control in the '361 patent. Reference can be made to the '361 patent for a detailed explanation of the interrelationships and workings of these elements. The voice "period" control and address generator 18 receives the control signal key down reset, KDR, from the tone generator control 12. KDR indicates the actuation or depression of one of the key switches 14 which causes the outputs of the voice "period" control and address generator 18 to be reset to a "0" state. The voice "period" control and address generator 18 will begin to count or advance at a rate proportional to the frequency number received by the voice sample address generator, as presented to the generator 18 by the MSB/VSA signal line. Thus, the recirculation of the quasi-periodic component is effectively controlled by the generator 18.

The attack/decay processor 20 performs functions similar to the attack/decay processor of the '361 patent and reference may be made to that patent for a more detailed explanation of the workings of the attack-/decay processor. As in the '361 patent, the attack-/decay processor 20 is supplied with a single rate source, the decay clock. As such, it is permitted to go full scale on detecting the onset of a tone with the decay clock indicating the length of decay required for the tone. Onset of the tone is indicated by the A/D control signals, the ATK and CLRP signals, which are described in the '361 patent and which are incorporated herein by reference.

Figure 3A:
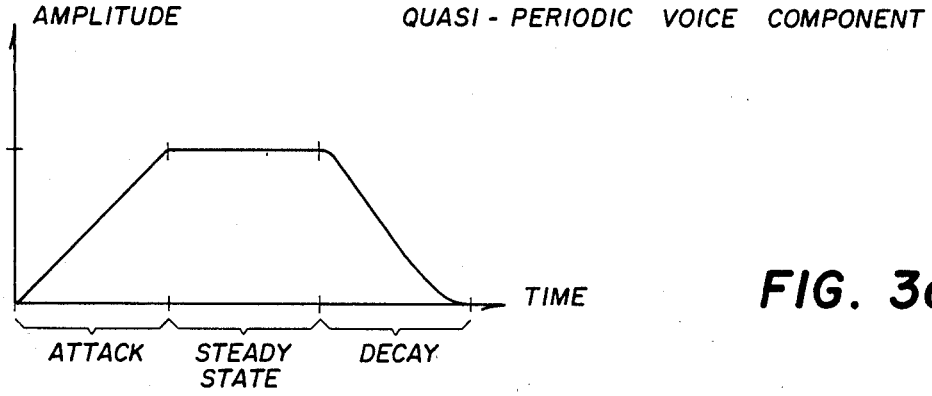
FIGS. 3*a*, 3*b* and 3*c* are graphical representations of the envelope waveshapes for the attack and decay transients and the steady-state of the "quasi-periodic" components of an organ pipe or other voice in the associated attack/decay processors for replicating such voice in accordance with the present invention.
Figure 3B:
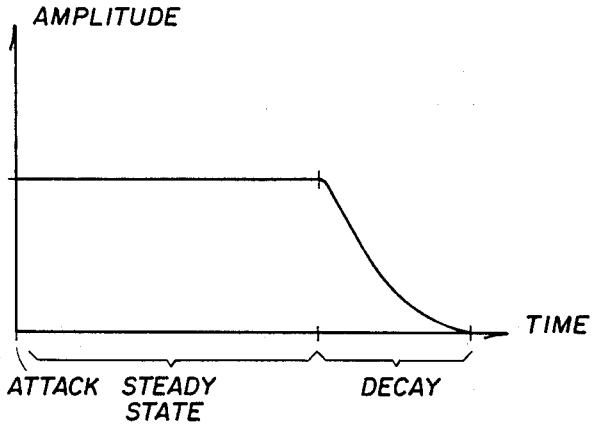
Figure 3C:
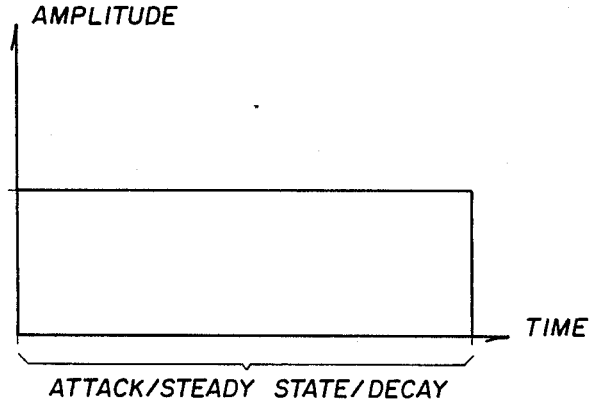

Referring now to FIGS. 3*a*, 3*b* and 3*c*, FIG. 3*a* shows the complete artificial control of the envelope waveshape applied to the quasi-periodic components of the selected voice, a gradually increasing attack, a fairly constant steady-state, and a gradually diminishing decay. FIG. 3*b* shows the instantaneous full-scale value at the onset of the tone which is indicative of only partial control of the quasi-periodic components of the selected voice. The quasi-periodic voice component is permitted to exhibit whatever natural attack transient and steady-state envelope characteristics were present at the time of recording of the tone with the artificial envelope gradually diminishing the steady-state to create its decay stage. FIG. 3c shows the complete lack of artificial control of the envelope waveshape. The quasi-periodic components of the selected voice are permitted to exhibit whatever natural transient and steady-state characteristics which were present at the time of recording. Hence, the envelope information is contained entirely in the quasi-periodic component waveform. These three examples of envelope waveshape control are not exclusive of others and are preferred merely as examples of means for control of the envelope waveshapes.

Returning to FIG. 1, the the attack/decay processor 20 exerts partial artificial control over the envelope waveshape in controlling the digital-to-analog converter associated with the quasi-periodic voice component waveshape memory 16, DAC-QPVC. This control mechanism will be more fully described below.

The voice "period" control and address generator 18 creates an output, the voice period address, VPA, which is applied as another part of the address to the quasi-periodic voice component waveshape memory 16 along with the VSA. The final portion of the address to the quasi-periodic voice component waveshape memory 16 is the QPVC select signal which emanates from the voice selection control 22. The voice selection control 22 receives information from the stop tab switches 24 indicating the performer's choice or selection of tones or voices he or she desires and timing and synchronization signals from the tone generator control 12. The timing and synchronization signals permit the synchronizing of actuated keys with the desired voices for the resultant tones in the multiplexed format of a limited number of tone generator and tone generator channels fewer in number than the number of keys and stop tabs. The timing and synchronizing techniques are more completely described in the early patents related to electronic musical instruments employing digital technology for the replicating of tones, e.g. the Deutsch and Watson patents, which description in the patents is incorporated herein by reference. The reader should note that certain elementary timing signals such as a master clock, MCLK, and multiplexing synchronization timings, BT, indicated in some of the earlier patents assigned to the assignee of the present invention, have been omitted herein as they are considered well known and accepted as the standard for the electronic musical instruments manufactured today. These signals are, however, required for operation of the circuits forming the present invention and are deemed sufficiently well known and understood by electronics engineers designing circuits in the digital area that further explanation herein is not considered necessary to the present description.

The voice selection control 22 receives information from the stop tabs or switches 24 in accordance with the timing and synchronization signals and provides the QPVC select signal to the quasi-periodic voice component waveshape memory 16. The QPVC select signal indicates the particular quasi-periodic voice waveshape which is desired to be sequentially read from the memory 16 at the respective time in accordance with the overall timing of the electronic musical instrument.

The voice selection control 22 also provides the PVC select signal to the periodic voice component waveshape memories 1, 2. In similar fashion as with the quasi-periodic voice component waveshape memory 16, periodic voice waveshape memories 1, 2 respond to the PVC select signal to sequentially read out the selected voice in accordance with the overall timing of the electronic musical instrument.

The periodic voice waveshape memories 1, 2 contain the voice waveform information of several different voices. This waveform information is accessed and sequentially read out of the memory in accordance with the address line inputs received from the voice selection control 22 (PVC select), the respective voice sample address generator 1 or 2 (VSA), and the tone generator control (keyboard region select). The PVC select signal indicates the particular voice(s) or tone(s) desired to be played. The keyboard region select signal indicates which of several related voice waveshapes for each of several different keyboard regions is to be selected. The selection is dependent upon the keyboard region in which the actuated or depressed key is located. A number code is generated by the tone generator control 12 which indicates in which keyboard region the actuated or depressed key lies. The combination of the PVC select signal and the keyboard region select signal will access the particular voice waveshape location in the periodic voice component waveshape memories 1, 2. The VSA signal will cause each of the memories 1, 2 to sequentially read out the particular waveform information at the appropriate frequency related to the pitch of the actuated or depressed key indicated by the frequency number applied to the voice sample address generator.

The quasi-periodic voice component waveshape generator 16 functions in similar fashion. The quasi-periodic voice component waveshape memory 16 contains the quasi-periodic waveshape information associated with particular voices or tones obtained in accordance with the method described above. The voice selection control 22 by the QPVC select signal indicates the particular quasi-periodic component corresponding to the desired voices or tones selected by the performer. The voice period address, VPA, and the voice sample address, VSA, in combination, will cause the memory 16 to sequentially read out the stored samples of the particular quasi-periodic voice component associated with the selected voices or tones during the transient and steady state portions of the tone at the appropriate frequency related to the pitch of the actuated or depressed key.

The numerical representation of the quasi-periodic voice component waveshape appearing at the output of memory 16 is applied to the input of DAC-QPVC. This DAC functions in similar fashion as the two-stage DAC in the '361 patent. The first stage of the DAC-QPVC accepts the raw data from the memory 16 and converts that data to a voltage the relative amplitude of which is controlled by the output of the attack/decay processor 20 which provides the envelope characteristics of the quasi-periodic voice component. The converted quasi-periodic voice component waveform is applied to a summing point along with the output of DAC-PVC 1 to serve as the input to the audio amplifier 26 which forms part of the audio channel 1.

The numerical representation of the periodic voice component waveshape memories 1, 2 appearing at their outputs is applied to the inputs of DAC-PVC 1 and 2. These DAC's function in similar fashion as the adder, attack/decay scaler, and digital-to-analog converter in the '403 patent. The attack/decay processor 28 provides the scale factors, voltage levels, for the DAC-PVC 1, 2.

Figure 2:
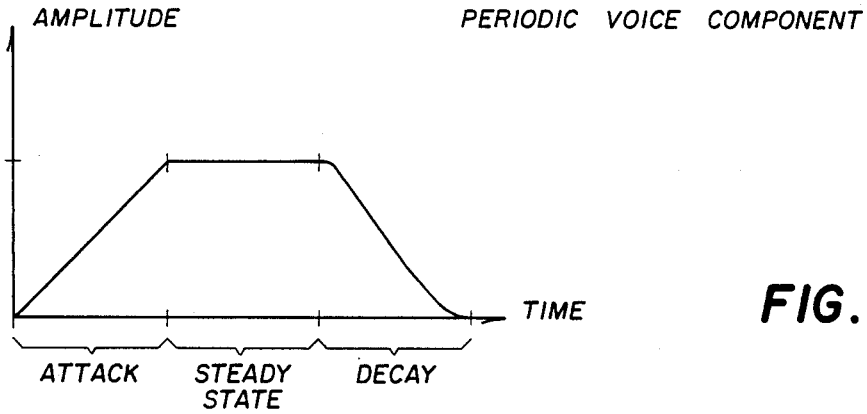
FIG. 2 is a graphical representation of the envelope waveshape for the attack and decay transients and the steady-state of the "periodic" components of an organ pipe or other voice in the associated attack/decay processors for replicating such voice in accordance with the present invention.

The attack/decay processor 28 receives the identical A/D control input data, ATK and CLRP, as the attack-/decay processor 20. In this case, however, the processor 28 has a somewhat different configuration than the processor 20. The attack/decay processor 28 consists of an attack/decay counter, an adjustable or fixed attack-/decay rate source (attack/decay clock), and a counter clearing means responsive to the A/D control signals, ATK and CLRP. The generated counter addresses are converted to envelope amplitude scale factors associated with the selected voices and applied to the attack-/decay scaler all in accordance with the detailed description thereof in the '403 patent which is incorporated herein by reference. Hence the attack/decay processor 28 provides envelope control via the DAC-PVC 1 and 2 in processing and converting the raw waveform information appearing at the respective outputs of the periodic voice component waveshape memories 1, 2. Reference can be made to FIG. 2 to show the envelope associated with the attack, steady state and decay of a periodic voice component of the selected voices or tones. The periodic voice component is permitted to gradually increase in amplitude during the attack transient portion, held at a fixed level during the steady state portion, and gradually decreased during the decay portion.

The converted periodic voice component waveshape from DAC-PVC 1 is applied to a summing point along with the output of DAC-QPVC to serve as the input to the audio amplifier 26 which forms part of the audio channel 1. The converted periodic voice component waveshape from DAC-PVC 2 is applied to the input of audio amplifier 30 which forms part of the audio channel 2. An alternate or equivalent method of summing the outputs of the periodic voice component waveshape memory with the quasi-periodic voice component waveshape memory would be to apply these outputs to a digital adder to sum the numerical representations of the waveshapes of each of the memories before converting the summed digital representation of the compound voice waveshape to an analog voltage in a digital-to-analog converter. The output of the digital-to-analog converter would be applied directly to an audio channel without the need for an intermediate summing means.

Each of the audio channels 1, 2 consists of an arrangement of one or more acoustic speakers in addition to the amplifiers 26, 30. Each of the periodic voice component tone generators comprises respectively a voice sample address generator, a periodic voice component waveshape memory, and digital-to-analog convertor with associated control circuitry for producing tones in separate audio channels to achieve the required spatial separation. Frequency separation is achieved by supplying different frequency numbers to the respective voice sample address generators.

Attack/decay processor 28 is shared by both basic periodic tone generators. This is because it is often aesthetically acceptable to utilize the same attack and decay characteristics for several basic periodic tone generators even though the harmonic structures of the voices produced by the various generators is different. If aesthetics demands separate attack and decay characteristics for each generator, then a separate attack-/decay processor 28 would have to be provided for each generator.

Audio channel 1 contains both the periodic voice components and the quasi-periodic voice components of the tone. Audio channel 2 contains only the periodic voice components of the tone. The quasi-periodic voice components may also be added into other tone generating channels without destroying the frequency or spatial separation. This demonstrates that the quasi-periodic voice components may be shared among several different tones producing a savings in memory elements and associated cost.

Figure 4:
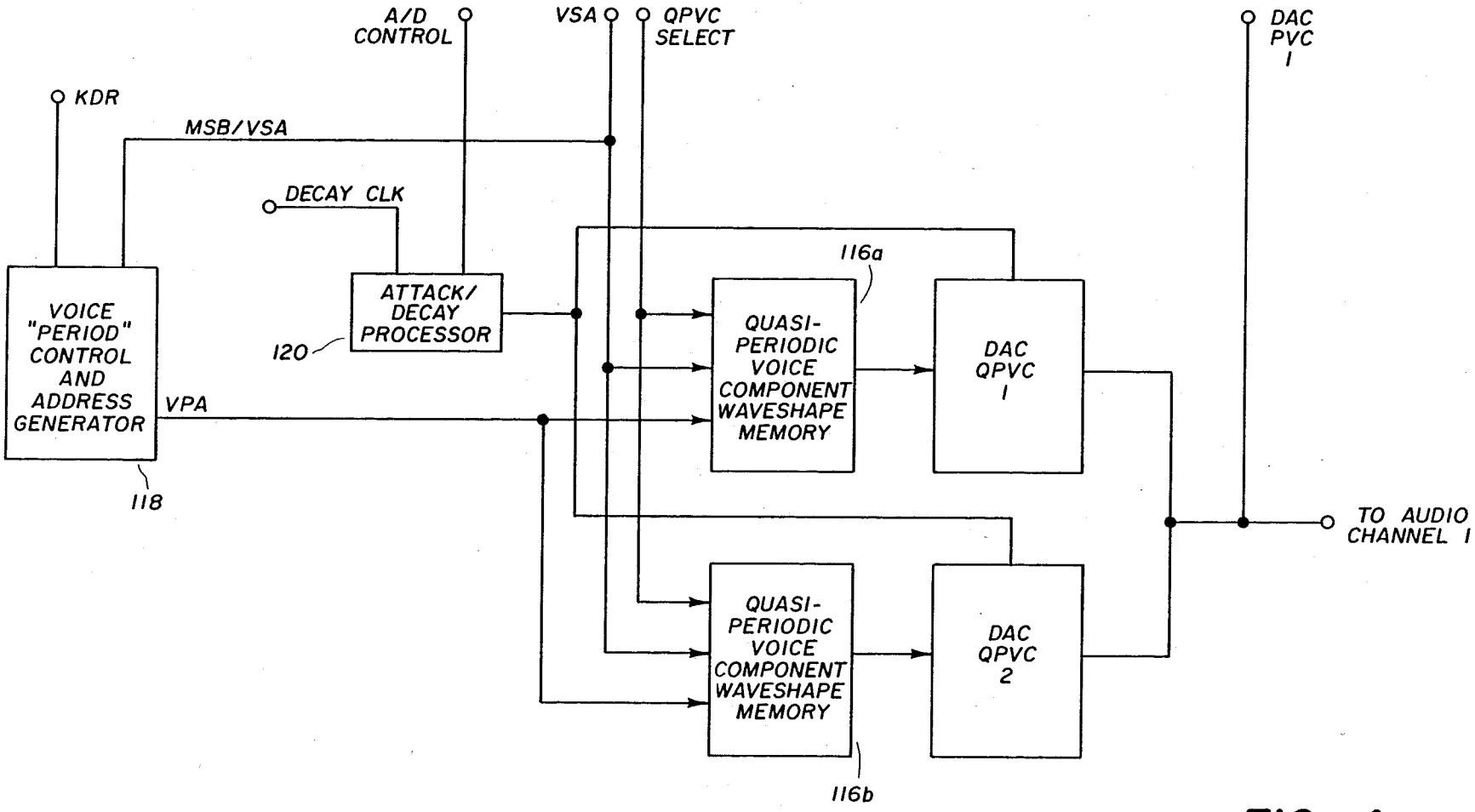
FIG. 4 is a schematic diagram, in the form of a block diagram, of an electronic musical instrument showing an alternate embodiment of the apparatus for replicating the compound musical tones in accordance with the present invention.

Referring now to FIG. 4, an alternate embodiment of the present invention is described. A configuration of elements similar to that described in connection with FIG. 1 is used. A voice "period" control and address generator 118 receives the identical signals, KDR and MSB/VSA, as previously described, each having the same effect on operation of the element 118. An attack-/decay processor 120 receives the identical signals, decay clk and A/D control, and functions in the manner previously described. The output of the voice "period" control and address generator 118, VPA, is applied to each of two quasi-periodic voice component waveshape memories, **116*a* and 116*b*. The other address lines to the memories 116*a*, 116*b* are VSA, from the voice sample address generator 1, and QPVC select, from the voice selection control 22. Each of the two memories 116*a*, 116*b*** contain quasi-periodic voice component information associated with particular voices or tones and functions as follows.

The voice selection control 22, via the QPVC select signal, indicates the particular quasi-periodic component corresponding to the desired voice(s) or tone(s) selected by the performer by actuation of the stop tabs or switches 24. Thus, the QPVC select enables one or both memories **116*a*, 116*b*. The voice period address, VPA, and the voice sample address, VSA, in combination, will cause the memories 116*a*, 116*b* to sequentially read out the stored samples of the particular quasi-periodic voice component associated with the selected voice(s) or tone(s) during the transient and steady state portions of the replicated tone at the appropriate frequency or pitch of the actuated or depressed key switch or switches 14**.

The numerical representation of the quasi-periodic voice component waveshape appearing at the output of the memories **116*a*, 116*b* is applied to the inputs to DAC-QPVC 1 and 2, respectively. The DAC's function in similar fashion to the DAC-QPVC described above and the two-stage DAC in the '361 patent. The first stage 116*a*, 116*b* and convert that data to a voltage the relative amplitude of which is controlled by the output of the attack/decay processor 120. The converted quasi-periodic voice component waveform of both DAC-QPVC's 1 and 2 are applied to a summing point along with the output of a DAC-PVC to be applied to the input of an audio channel, e.g. audio channel 1. Thus, one or more memories containing quasi-periodic voice component information may be added into a single audio channel associated with the digital electronic musical instrument of the present invention to make available additional quasi-periodic voice components to the electronic musical instrument designer. In addition, a hardware savings is achieved through the sharing of the recirculation logic of the voice "period" control and address generator 118 with two quasi-periodic voice component waveshape memories, i.e. 116*a* and 116*b***.

It has been determined that the "unstable" or quasi-periodic components of the tones are substantially similar to each other. Hence, a single quasi-periodic voice component may be used with several different tones having different pitches without loss of the desired aesthetic realism of replication of instrument sound. The application of the quasi-periodic voice component at the onset of the tone creates the aesthetically desired "chiff" and musically interesting tone during the attack transient portion of the voice. The recirculating of the quasi-periodic voice component provides the realism of air column movement in a pipe, or other acoustic or non-acoustic instrument, and more realistic change of tone during the steady state portion of the voice. Thus, the separation of the quasi-periodic voice component from the overall waveshape of the tone and its reintroduction at the appropriate times and in the appropriate amounts to the overall replication of the desired tone gives rise to achieving the aesthetically realistic sound so long sought after by electronic musical instrument designers.

The present invention may be embodied in other specific forms without departing from the spirit or essential attributes thereof and, accordingly, reference should be made to the appended claims rather than to the specification as indicating the scope of the invention.

We claim:

1. In an electronic musical instrument having a keyboard for allowing the production of sounds corresponding to selected voices at pitches corresponding to respective notes of a musical scale as indicated by depressed keys, a method of deriving and replicating compound voice waveforms spanning transient and steady-state portions of the selectable voices of said instrument comprising the steps of:

deriving periodic and quasi-periodic components from said compound voice waveforms by separating unstable quasi-periodic component waveforms of the selected voices containing combinations of non-harmonics along with some harmonics of the selected voices from stable periodic component waveforms of the selected voices containing the fundamental and a number of the significant harmonics of the selected voices;

storing the quasi-periodic component waveforms of the selected voices;

storing the stable periodic component waveforms of the selected voices;

generating addresses for selectively causing the reading of the quasi-periodic component waveform of at least one selected voice from storage in accordance with the selective actuation of keys and switches for choosing notes and voices;

generating addresses for selectively causing the reading of the periodic component waveform of one or more selected voices from storage in accordance with the selective actuation of keys and switches for choosing notes and voices;

combining and converting the waveform output of the quasi-periodic component with one or more waveform outputs of the periodic component to replicate the compound voice waveform of the one or more selected voices through an audio amplification system.

2. A method in accordance with claim 1 further comprising a step of providing artificial control of the periodic component waveform envelope and selectively providing artificial control of the quasi-periodic component waveform envelope.

3. A method in accordance with claim 2 further comprising the steps of providing for complete artificial control of the envelopes of the quasi-periodic component waveform and the periodic component waveform by causing, at the onset of the sounding of an selected voice, the envelope control waveform applied to the quasi-periodic component waveform to gradually increase to a predetermined value throughout the attack transient portion, to maintain that value throughout the steady-state portion, and to gradually diminish in value to effect the decay transient portion of the selected voice in response to the actuable key switches, and the envelope control waveform applied to the periodic component waveform to gradually increase to a predetermined value during the attack transient portion, to maintain that value throughout the steady-state portion, and to gradually diminish in value to effect the decay transient portion of the selected voice in response to said actuable key switches, during the replication and sounding of the selected voice.

4. A method in accordance with claim 2 further comprising the steps of providing for partial artificial control of the envelope of the quasi-periodic component waveform and complete artificial control of the envelope of the periodic component waveform by causing, at the onset of the sounding of an selected voice, the envelope control waveform applied to the quasi-periodic component waveform to instantaneously achieve a predetermined value and to maintain that value throughout the attack transient and steady-state portions and to gradually diminish in value to effect the decay transient portion of the selected voice in response to said actuable key switches, permitting whatever natural attack transient and steady-state characteristics of the quasi-periodic component waveform envelope to be replicated, and the envelope control waveform applied to the periodic component waveform to gradually increase to a predetermined value during the attack transient portion, to maintain that value throughout the steady-state portion, and to gradually diminish in value to effect the decay transient portion of the selected voice in response to said actuable key switches, during the replication and sounding of the selected voice.

5. A method in accordance with claim 2 further comprising the steps of providing for the replication of the natural envelope of the quasi-periodic component waveform and the complete artificial control of the envelope of the periodic component waveform by causing, at an onset of the sounding of the selected voice, the envelope control waveform applied to the quasi-periodic component waveform to instantaneously achieve a predetermined value and to maintain that value throughout the attack and decay transient and steady-state portions of the selected voice, permitting whatever natural transient and steady-state characteristics of the quasi-periodic component waveform envelope to be replicated, and the envelope control waveform applied to the periodic component waveform to gradually increase to a predetermined value during the attack transient portion, to maintain that value throughout the steady-state portion, and to gradually diminish in value to effect the decay transient portion of the selected voice in response to said actuable key switches, during the replication and sounding of the selected voice.

6. A method in accordance with claim 1 further comprising a step for selectively controlling the recirculation of the quasi-periodic component waveform during the replication and sounding of the selected voice.

7. A method in accordance with claim 1 further comprising a step for selectively turning off the quasi-periodic component of the selected voice.

8. A method in accordance with claim 1 further comprising a step for selectively enabling one or more quasi-periodic component storage means in accordance with the selective actuation of control or stop switches.

9. A method in accordance with claim 1 further comprising a step for selectively enabling one or more quasi-periodic component storage means in combination with one of more periodic component storage means in accordance with the selective actuation of control or stop switches.

10. A method in accordance with claim 1 further comprising a step for polyphonically replicating said compound voice waveforms.

11. The method in accordance with claim 1 wherein the method further comprises a step deriving the quasi-periodic and periodic component waveforms by separating upper spectral frequency components of the selected voices from lower spectral frequency components of the selected voices, said upper spectral frequency components being the quasi-periodic component waveforms containing combinations of the harmonic, and non-harmonic frequency components of the selected voices and said lower spectral frequency components being the periodic component waveforms containing combinations of the fundamental and harmonic frequency components of the selected voices.

12. The method in accordance with claim 1 wherein the method further comprises a step of selecting from among several quasi-periodic component waveforms of a selected voice a single quasi-periodic component waveform having characteristics which more closely represents the characteristics of the group of the several quasi-periodic component waveforms than any other quasi-periodic component waveform of the selected voice and storing only the selected quasi-periodic component waveform.

13. The method in accordance with claim 1 wherein the step of reading the periodic component waveform from storage includes generating addresses for selectively causing the reading of the periodic component waveform of the selected voice corresponding to the appropriate keyboard region.

14. In an electronic musical instrument allowing the production of sounds corresponding to depressed keys representing respective notes of a musical scale, a method of reproducing sounds representative of selected predetermined voices and selected keys and switches of said instrument comprising the steps of:

deriving periodic and quasi-periodic component waveforms representative of the predetermined voices;

storing at least one quasi-periodic component waveforms;

storing the periodic component waveforms' generating addresses for selectively causing the reading of at least one quasi-periodic component waveform from storage in accordance with the selected predetermined voices and depressed keys;

generating addresses for selectively causing the reading of the periodic component waveforms from storage in accordance with the selected predetermined voices and depressed keys;

converting the waveform output of the quasi-periodic component and the waveform output of the periodic component into sounds corresponding to the selected predetermined voices.

15. A method in accordance with claim 14 further comprising a step of providing artificial control of the periodic component waveform envelope and selectively providing artificial control of the quasi-periodic component waveform envelope.

16. A method in accordance with claim 15 further comprising the steps of providing for complete artificial control of the envelopes of the quasi-periodic component waveform and the periodic component waveform by causing, at the onset of the sounding of an selected voice, the envelope control waveform applied to the quasi-periodic component waveform to gradually increase to a predetermined value throughout the attack transient portion, to maintain that value throughout the steady-state portion, and to gradually diminish in value to effect the decay transient portion of the selected voice in response to the actuable key switches, and the envelope control waveform applied to the periodic component waveform to gradually increase to a predetermined value during the attack transient portion, to maintain that value throughout the steady-state portion, and to gradually diminish in value to effect the decay transient portion of the selected voice in response to said actuable key switches, during the replication and sounding of the selected voice.

17. A method in accordance with claim 15 further comprising the steps of providing for partial artificial control of the envelope of the quasi-periodic component waveform and the complete artificial control of the envelope of the periodic component waveform by causing, at the onset of the sounding of an selected voice, the envelope control waveform applied to the quasi-periodic component waveform to instantaneously achieve a predetermined value and to maintain that value throughout the attack transient and steady-state portions and to gradually diminish in value to effect the decay transient portion of the selected voice in response to said actuable key switches, permitting whatever natural attack transient and steady-state characteristics of the quasi-periodic component waveform envelope to be replicated, and the envelope control waveform applied to the periodic component waveform to gradually increase to a predetermined value during the attack transient portion, to maintain that value throughout the steady-state portion, and to gradually diminish in value to effect the decay transient portion of the selected voice in response to said actuable key switches, during the replication and sounding of the selected voice.

18. A method in accordance with claim 15 further comprising the steps of providing for the replication of the natural envelope of the quasi-periodic component waveform and complete artificial control of the envelope of the periodic component waveform by causing, at the onset of the sounding of the selected voice, an envelope control waveform applied to the quasi-periodic component waveform to instantaneously achieve a predetermined value and to maintain that value throughout the attack and decay transient and steady-state portions of the selected voice, permitting whatever natural transient and steady-state characteristics of the quasi-periodic component waveform envelope to be replicated, and the envelope control waveform applied to the periodic component waveform to gradually increase to a predetermined value during the attack transient portion, to maintain that value throughout the steady-state portion, and to gradually diminish in value to effect the decay transient portion of the selected voice in response to said actuable key switches, during the replication and sounding of the selected voice.

19. A method in accordance with claim 14 further comprising a step for selectively controlling the recirculation of the quasi-periodic component waveform during the replication and sounding of the selected voice.

20. A method in accordance with claim 14 further comprising a step for selectively turning off the quasi-periodic component of the selected voice.

21. A method in accordance with claim 14 further comprising a step for selectively enabling one or more quasi-periodic component storage means in accordance with the selective actuation of control or stop switches.

22. A method in accordance with claim 14 further comprising a step for selectively enabling one or more quasi-periodic component storage means in combination with one of more periodic component storage means in accordance with the selective actuation of control or stop switches.

23. A method in accordance with claim 14 further comprising a step for polyphonically replicating said compound voice waveforms.

24. The method in accordance with claim 14 wherein the method further comprises a step of deriving the quasi-periodic and periodic component waveforms by separating upper spectral frequency components of the predetermined voices from lower spectral frequency components of the predetermined voices, said upper spectral frequency components being the quasi-periodic component waveforms containing combinations of harmonic and non-harmonic frequency components of the predetermined voices and said lower spectral frequency components being the periodic component waveforms containing combinations of the fundamental and harmonic frequency components of the predetermined voices.

25. The method in accordance with claim 14 wherein the method further comprises a step of selecting from among two or more quasi-periodic component waveforms of one or more predetermined voices a single quasi-periodic component waveform having characteristics which more closely represent the characteristics of the group of the two or more quasi-periodic component waveforms than any other quasi-periodic component waveform of the one or more predetermined voices and storing only the selected quasi-periodic component waveform.

26. The method in accordance with claim 14 wherein the step of reading from the periodic component storage means includes generating addresses for selectively causing the reading of the periodic component waveform of the selected voice corresponding to the appropriate keyboard region.

* * * * *